US005252453A

United States Patent [19]

Tsaur et al.

[11] Patent Number: 5,252,453

[45] Date of Patent: Oct. 12, 1993

[54] PROCESS FOR ACCELERATING THE PRECIPITATION OF A LOW COEFFICIENT OF VARIATION EMULSION

[75] Inventors: Allen K. Tsaur; Mamie Kam-Ng, both of Fairport; Sang H. Kim, Pittsford, all of N.Y.

[73] Assignee: Eastman Kodak Company, Rochester, N.Y.

[21] Appl. No.: 971,126

[22] Filed: Nov. 4, 1992

[51] Int. Cl.[5] ..... G03C 1/015

[52] U.S. Cl. ..... 430/569; 430/567; 430/637

[58] Field of Search ..... 430/567, 569, 637

[56] References Cited

U.S. PATENT DOCUMENTS 5,147,771 9/1992 Tsaur et al. ..... 430/569
5,147,772 9/1992 Tsaur et al. ..... 430/569
5,147,773 9/1992 Tsaur et al. ..... 430/569
5,171,659 12/1992 Tsaur et al. ..... 430/569

*Primary Examiner*—Janet C. Baxter
*Attorney, Agent, or Firm*—Carl O. Thomas

[57] ABSTRACT

A process is disclosed of accelerating the preparation of a photographic emulsion containing tabular silver halide grains exhibiting a reduced degree of total grain dispersity. A dispersing medium is provided containing bromide ions, and a population of silver halide grain nuclei containing parallel twin planes is formed in the dispersing medium. A portion of the grain nuclei are ripened out, and then the silver halide grain nuclei containing parallel twin planes remaining are grown to form tabular silver halide grains. A polyalkylene oxide containing both hydrophilic and lipophilic block units is selected from among those known to be capable of reducing total grain dispersity when present during nucleation. However, in this process precipitation is accelerated while maintaining low dispersity of the total grain population by forming twin planes in the grain nuclei within the pAg and temperature boundaries of Curve A in FIG. 1 and by delaying introduction of the polyalkylene oxide block copolymer surfactant until after the silver halide nuclei containing twin planes have been formed.

18 Claims, 1 Drawing Sheet

PROCESS FOR ACCELERATING THE PRECIPITATION OF A LOW COEFFICIENT OF VARIATION EMULSION

FIELD OF THE INVENTION

The invention relates to a process of precipitating a tabular grain silver halide emulsion to be used in photography.

BACKGROUND

Although tabular grains had been observed in silver bromide and bromoiodide photographic emulsions dating from the earliest observations of magnified grains and grain replicas, it was not until the early 1980's that photographic advantages, such as improved speed-granularity relationships, increased covering power both on an absolute basis and as a function of binder hardening, more rapid developability, increased thermal stability, increased separation of blue and minus blue imaging speeds, and improved image sharpness in both mono- and multi-emulsion layer formats, were realized to be attainable from silver bromide and bromoiodide emulsions in which the majority of the total grain population based on grain projected area is accounted for by tabular grains satisfying the mean tabularity relationship:

$$D/t^2 > 25$$

where

D is the equivalent circular diameter (ECD) in micrometers (μm) of the tabular grains and t is the thickness in μm of the tabular grains. Once photographic advantages were demonstrated with tabular grain silver bromide and bromoiodide emulsions techniques were devised to prepare tabular grains containing silver chloride alone or in combination with other silver halides. Subsequent investigators have extended the definition of tabular grain emulsions to those in which the mean aspect ratio (D:t) of grains having parallel crystal faces is as low as 2:1.

Notwithstanding the many established advantages of tabular grain silver bromide and bromoiodide emulsions, the art has observed that these emulsions tend toward more disperse grain populations than can be achieved in the preparation of regular, untwinned grain populations--e.g., cubes, octahedra and cubo-octahedral grains. This has been a concern, since reducing grain dispersity is a fundamental approach to reducing the imaging variance of the grains, and this in practical terms can be translated into more nearly uniform grain responses and higher mean grain efficiencies in imaging.

Tsaur et al U.S. Pat. Nos. 5,147,771; 5,147,772 and 5,147,773 and U.S. Ser. No. 700,019, filed May 14, 1991, commonly assigned and now U.S. Pat. No. 5,171,659 titled PROCESS OF PREPARING A REDUCED DISPERSITY TABULAR GRAIN EMULSION, (hereinafter collectively referred to as Tsaur et al) has provided a solution to the problem of elevated grain dispersities in tabular grain emulsions. Tsaur et al employs a post nucleation solvent ripening process for preparing tabular grain emulsions. That is, at a point in the precipitation process in which the grains contain the parallel twin planes necessary for tabularity a silver halide solvent is introduced to ripen out a portion of the grains. This narrows the dispersity of the grain population and reduces the dispersity of the final tabular grain emulsion produced. The post nucleation solvent ripening processes of Tsaur et al further reduce total grain dispersity in precipitating tabular grain emulsions by introducing a selected polyalkylene oxide block copolymer surfactant containing both hydrophilic and lipophilic block units into the dispersing medium at the outset of tabular grain formation.

Tsaur et al has been able to produce tabular grain emulsions in which the grain size dispersity of the total grain population is quite low. A technique for quantifying grain dispersity that has been applied to both nontabular and tabular grain emulsions is to obtain a statistically significant sampling of the individual grain projected areas, calculate the corresponding ECD of each grain, determine the standard deviation of the grain ECDs, divide the standard deviation of the grain population by the mean ECD of the grains sampled and multiply by 100 to obtain the coefficient of variation (COV) of the grain population as a percentage. The Tsaur et al precipitation processes are generally applicable to producing tabular grain emulsions having a relatively low dispersity of the total grain population (COV<30 percent). In most instances the precipitation processes of Tsaur et al produce tabular grain emulsions with a total grain population COV of less than 20 percent and, under specifically selected conditions, with a total grain population COV of less than 10 percent, an extremely low dispersity level for tabular or nontabular grain emulsions.

Although Tsaur et al has effectively solved the long standing problem of grain dispersity in tabular grain emulsions, the precipitation processes of Tsaur et al have presented the disadvantage that the presence of a polyalkylene oxide block copolymer surfactant in the dispersing medium at the outset of tabular grain formation slows the growth of the tabular grains. In other words, for a given elapsed period of precipitation a lower average tabular grain ECD is realized using any one of the Tsaur et al processes as compared to a comparable process not employing the polyalkylene oxide block copolymer surfactant. The elapsed time to reach a selected average tabular grain ECD, particularly where moderate and higher(>2 μm) tabular grain ECDs are contemplated, is a matter of importance in the manufacture of photographic materials.

SUMMARY OF THE INVENTION

Figure 1:
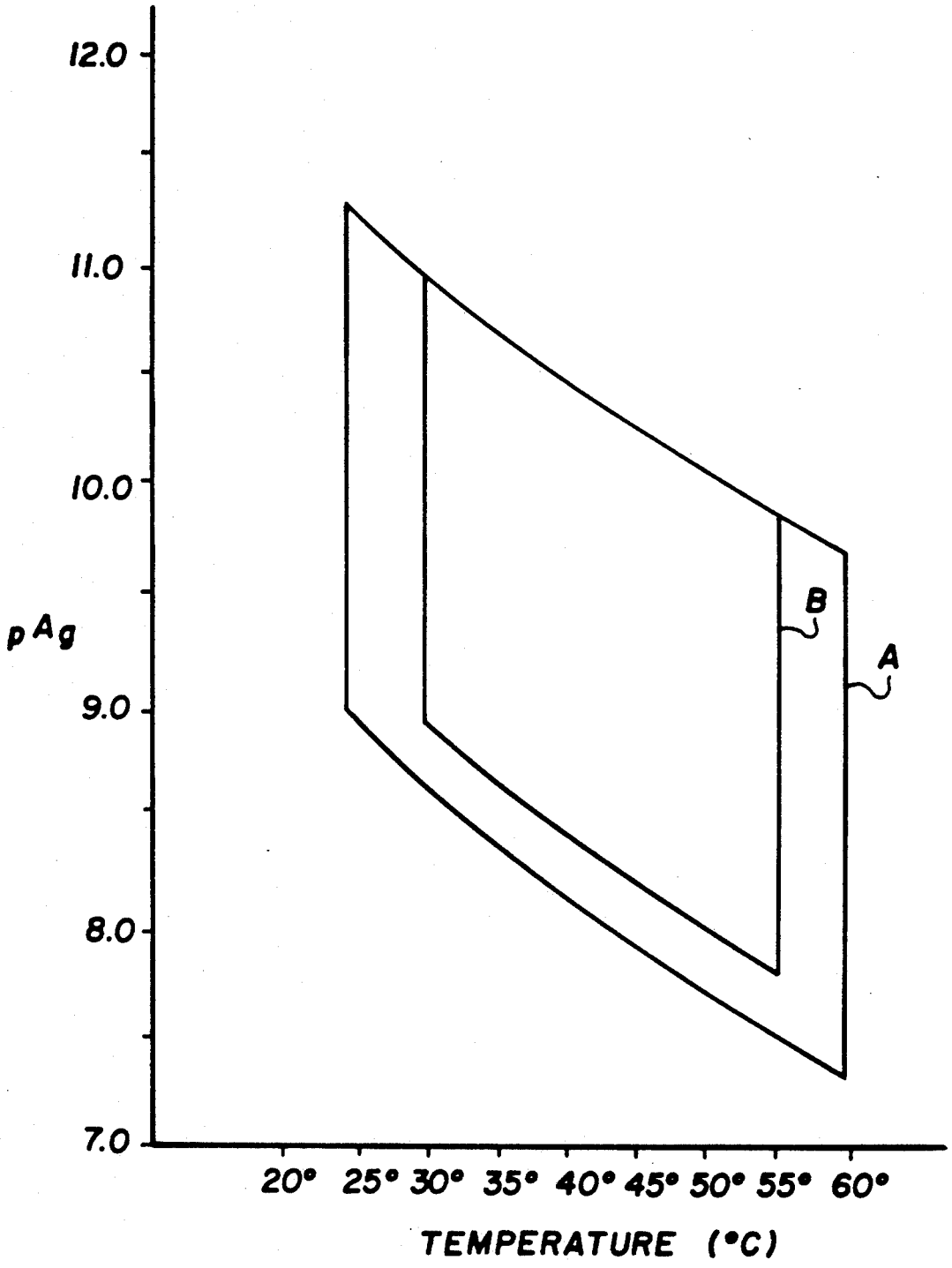
FIG. 1 is a plot of pAg versus temperature showing contemplated and preferred ranges for nucleation accounting to the process of the present invention.

The present invention is an improvement of the tabular grain precipitation processes of Tsaur et al. Specifically, it has been discovered that the advantages of reduced total grain dispersity in tabular grain emulsions taught by Tsaur et al can be realized while increasing the rate of emulsion precipitation. The magnitude of the latter advantage of the precipitation process of the invention increases as higher average equivalent circular diameters of the tabular grains are sought.

In one aspect, this invention is directed to a process of accelerating the preparation of a photographic emulsion containing tabular silver halide grains exhibiting a reduced degree of total grain dispersity comprising (1) providing a dispersing medium containing halide ions consisting essentially of bromide ions, (2) forming in the dispersing medium a population of silver halide grain nuclei containing parallel twin planes, (3) ripening out a portion of the grain nuclei, and (4) growing the silver halide grain nuclei containing parallel twin planes remaining to form tabular silver halide grains, wherein (5) the twin planes are formed in the silver halide grain nuclei within the pAg and temperature boundaries of Curve A in FIG. 1 and (6) a polyalkylene oxide block copolymer surfactant is introduced into the emulsion, introduction being delayed until after the silver halide nuclei containing twin planes have been formed, but introduction occurring before 25 percent of the total silver used to form the emulsion has been introduced, the surfactant being chosen from the class consisting of (a) polyalkylene oxide block copolymer surfactants comprised of at least two terminal lipophilic alkylene oxide block units linked by a hydrophilic alkylene oxide block unit accounting for from 4 to 96 percent of the molecular weight of the copolymer and (b) polyalkylene oxide block copolymer surfactants comprised of at least two terminal hydrophilic alkylene oxide block units linked by a lipophilic alkylene oxide block unit accounting for from 4 to 96 percent of the molecular weight of the copolymer.

DESCRIPTION OF PREFERRED EMBODIMENTS

The present invention is an improvement on a post nucleation solvent ripening processes of Tsaur et al, cited above and here incorporated by reference, for preparing tabular grain emulsions. The process of the invention, like the processes of Tsaur et al, reduces both the overall dispersity of the grain population and the dispersity of the tabular grain population, but the process of the invention grows larger average ECD tabular grains for a selected time of precipitation than can be obtained employing a comparable process of Tsaur et al.

In a post nucleation solvent ripening process for preparing tabular grain emulsions the first step is to form a population of silver halide grain nuclei containing parallel twin planes. A silver halide solvent is next used to ripen out a portion of the silver halide grain nuclei, and the silver halide grain nuclei containing parallel twin planes not ripened out are then grown to form tabular silver halide grains.

To achieve the lowest possible grain dispersities the first step is to form the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. Prior to introducing the silver salt a small amount of bromide salt is added to the reaction vessel to establish a slight stoichiometric excess of halide ion. One or both of chloride and iodide salts can be introduced through the bromide jet or as a separate aqueous solution through a separate jet. It is preferred to limit the concentration of chloride and/or iodide to about 20 mole percent, based on silver, most preferably these other halides are present in concentrations of less than 10 mole percent (optimally less than 6 mole percent) based on silver. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH--i.e., less than 7.0.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

The present invention achieves reduced grain dispersity by producing prior to ripening a population of parallel twin plane containing grain nuclei. The invention is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

The improved process of the present invention is based on the discovery that both the low levels of total grain dispersity produced by Tsaur et al and larger tabular grain ECDs for a given period of precipitation can be achieved by departing from the teachings of Tsaur et al in two respects. First, addition of polyalkylene oxide block copolymer surfactant, relied upon by Tsaur et al to reduce grain dispersity, is delayed until after a grain nuclei population containing twin planes have been formed. Second, at the stage of introducing parallel twin planes in the grain nuclei, either during initial formation of the grain nuclei or immediately thereafter, the lowest attainable levels of grain dispersity in the completed emulsion are achieved by control of the dispersing medium within a limited range of pAg levels.

Whereas Tsaur et al teaches the pAg of the dispersing medium to be maintained during twin plane formation within the range of from 5.4 to 10.3 (at a temperature of 45° C.), it has been discovered that a more limited pAg range is required for forming twin planes in the absence of the polyalkylene oxide block copolymer if grain dispersity to be maintained at a low level. It has been discovered that in the absence of a polyalkylene oxide block copolymer low levels of grain dispersity can be realized, provided pAg during twin plane formation at 45° C. is maintained in the range of from 8.0 to 10.3, preferably 8.3 to 10.3. At a pAg of greater than 10.3 (at 45° C.) a tendency toward increased tabular grain ECD and thickness dispersities is observed. Any convenient conventional technique for monitoring and regulating pAg can be employed.

The contemplated range of temperatures for twin plane formation is from 25°to 60° C., preferably 30°to 55° C. When different temperatures of the dispersing medium are maintained during twin plane formation, the ranges of useful and preferred pAg of the dispersing medium must be adjusted. It is generally recognized that for silver halides the following equilibrium relationship exists:

$$-\log Ksp = pAg + pX$$

where $-\log Ksp$ is the negative base 10 logarithm of the solubility product constant of the silver halide;

pAg is the negative base 10 logarithm of the silver ion concentration in the dispersing medium; and pX is the negative base 10 logarithm of the halide ion concentration in the dispersin medium. The equivalence point of a dispersing medium (pAg=pX) corresponds to -log Ksp+2. Photographic emulsions are almost always precipitated on the halide excess side of the equivalence point to avoid fog. When precipitation temperatures are varied, it is common practice to adjust pAg so that the relationship of the silver ion concentration to the equivalence point is maintained. It is possible to adjust the pAg range limits set out above for 45° C. for any desired temperature within the temperature range limits merely by referring to published values of solubility product constants for silver halide at different temperatures. Attention is directed, for example, to Mees and James *The Theory of the Photographic Process*, 3th Ed., Macmillan, N.Y., 1966, page 6.

Curve A in FIG. 1 generalizes the 8.0 to 10.3 pAg range at 45° C. over the temperature range of from 25°to 60° C. Any pAg within the boundaries of Curve A is a useful temperature for twin plane formation in the absence of a polyalkylene oxide block copolymer surfactant. Curve B in FIG. 1 generalizes the preferred 8.3 to 10.3 pAg range at 45° C. over the preferred temperature range of 30 to 55° C. Preferred processes of preparation according to the practice of this invention form twin planes while the temperature of the dispersing medium is within the boundaries of Curve B in the absence of a polyalkylene oxide block copolymer surfactant.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. No. 4,722,886, the disclosures of which are here incorporated by reference.

Instead of introducing a silver halide solvent to induce ripening it is possible to accomplish the ripening step by adjusting pH to a high level—e.g., greater than 9.0. A ripening process of this type is disclosed by Buntaine et al U.S. Pat. No. 5,013,641. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 7.0) by introducing a conventional acidifying agent, such as a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition. Although the formation of grain nuclei incorporates bromide ion and only minor amounts of chloride and/or iodide ion, the low dispersity tabular grain emulsions produced at the completion of the growth step can contain in addition to bromide ions any one or combination of iodide and chloride ions in any proportions found in tabular grain emulsions. If desired, the growth of the tabular grain emulsion can be completed in such a manner as to form a coreshell emulsion of reduced dispersity. The shelling procedure taught by Evans et al U.S. Pat. No. 10 4,504,570 is here incorporated by reference. Internal doping of the tabular grains, such as with group VIII metal ions or coordination complexes, conventionally undertaken to obtain improved reversal and other photographic properties are specifically contemplated. For optimum levels of dispersity it is, however, preferred to defer doping until after the grain nuclei containing parallel twin planes have been obtained.

A polyalkylene oxide block copolymer surfactant selected as described below is introduced into the dispersing medium following the formation of grain nuclei containing twin planes. The lowest COVs based on the total grain population of the emulsion are attained by creating the twin plane containing grain nuclei using the smallest convenient fraction of total silver and, prior to commencing the subsequent growth step, introducing the polyalkylene oxide block copolymer surfactant. However, it is not essential that the polyalkylene oxide block copolymer be introduced prior to the growth step. To achieve COVs of less than 25 percent, based on the total grain population, it is contemplated to introduce the polyalkylene oxide into the dispersing medium before 25 percent of the total silver halide been introduced, although Example 7E below suggests that an even greater delay can be tolerated in some instances. It is preferred to produce emulsions having coefficients of variation of less than 20 percent and, optimally, less than 10 percent, based on the total grain population. It is preferred that the polyalkylene oxide be introduced into the dispersing medium before 10 percent and, optimally, before 5 percent of the total silver has been introduced. Delayed introductions of the polyalkylene oxide block copolymer commencing during the growth step are entirely compatible with utilizing minimal amounts of silver in forming the twin plane containing grain nuclei population.

The polyalkylene oxide block copolymer surfactants can take any of the forms taught to be useful by Tsaur et al, cited above. These surfactants contain both hydrophilic and lipophilic block units and are generally selected from among (a) polyalkylene oxide block copolymer surfactants comprised of at least two terminal lipophilic alkylene oxide block units linked by a hydrophilic alkylene oxide block unit accounting for from 4 to 96 percent of the molecular weight of the copolymer and (b) polyalkylene oxide block copolymer surfactants comprised of at least two terminal hydrophilic alkylene oxide block units linked by a lipophilic alkylene oxide block unit accounting for from 4 to 96 percent of the molecular weight of the copolymer.

One specifically preferred class of polyalkylene oxide block copolymers are those disclosed by Tsaur et al U.S. Pat. No. 5,147,771, wherein the surfactant copolymer satisfies the formula:

$$\text{LAO—HAO—LAO} \quad \text{(I)}$$

where

LAO—represents a terminal lipophilic alkylene oxide block unit,

—HAO—represents a linking hydrophilic alkylene oxide block unit and the molecular weight of the polyalkylene oxide block copolymer is in the range of from 760 to 16,000.

In a second preferred form taught by Tsaur et al U.S. Ser. No. 700,019, filed May 14, 1991, now U.S. Pat. No. 5,171,659, the surfactant satisfies the formula:

$$\text{HAO—LAO—HAO} \quad \text{(II)}$$

where

HAO—represents a terminal hydrophilic alkylene oxide block unit,

—LAO—represents a linking lipophilic alkylene oxide block unit, and the molecular weight of the polyalkylene oxide block copolymer is in the range of from 800 to 30,000.

In a third preferred form taught by Tsaur et al U.S. Pat. No. 5,147,773 the surfactant satisfies the formula: (III)

$$(\text{HAO})_z\text{—LOL—}(\text{HAO})_{z'} \quad \text{(III)}$$

where

HAO represents a terminal hydrophilic alkylene oxide block unit,

—LOL—represents a lipophilic alkylene oxide block linking unit, z is 2, z' is 1 or 2, and the molecular weight of the polyalkylene oxide block copolymer is in the range of from 1,100 to 60,000.

In a more specifically preferred form the polyalkylene oxide block copolymer of formula III satisfies the formula:

$$(\text{HAO—LAO})_z\text{—L—}(\text{LAO—HAO})_{z'} \quad \text{(IV)}$$

where

HAO—represents a terminal hydrophilic alkylene oxide block unit,

—LAO—represents a lipophilic alkylene oxide block unit, and

—L—represents an amine or diamine linking group.

In a fourth preferred form taught by Tsaur et al U.S. Pat. No. 5,147,772 the surfactant satisfies the formula:

$$(\text{LAO})_z\text{—HOL—}(\text{LAO})_{z'} \quad \text{(V)}$$

where

LAO—represents a terminal lipophilic alkylene oxide block unit,

—HOL—represents a hydrophilic alkylene oxide block linking unit, z is 2, z' is 1 or 2, and the molecular weight of the polyalkylene oxide block copolymer is in the range of from 1,100 to 50,000.

In a more specifically preferred form the polyalkylene oxide block copolymer of formula IV satisfies the formula:

$$(\text{LAO—HAO})_z\text{—L—}(\text{HAO—LAO})_{z'} \quad \text{VI}$$

where

LAO—represents a terminal lipophilic alkylene oxide block unit,

—HAO—represents a hydrophilic alkylene oxide block unit, and

—L—represents an amine or diamine linking group.

The lipophilic alkylene oxide block units preferably contain repeating units satisfying the formula:

$$-(\text{CH}\overset{\text{R}}{\overset{|}{\text{C}}}\text{H}_2\text{O})- \quad \text{(VII)}$$

where

R is a hydrocarbon of from 1 to 10 carbon atoms.

In a specifically preferred form R is methyl—i.e., the hydrocarbon moiety is a propane-1,2-diyl moiety.

The hydrophilic alkylene oxide block unit is preferably comprised of repeating units satisfying the formula:

$$-(\overset{R^1}{\overset{|}{C}}HCH_2O)- \quad \text{(VIII)}$$

where $R^1$ is hydrogen or a hydrocarbon of from 1 to 10 carbon atoms substituted with at least one polar group. In a specifically preferred form $R^1$ is hydrogen and the hydrocarbon moiety is an ethylene moiety.

The preferred polyalkylene oxide block copolymer surfactants of formula I above are those satisfying the formula:

$$HO-(\overset{CH_3}{\overset{|}{C}}HCH_2O)_x-(CH_2CH_2O)_y-(CH_2\overset{CH_3}{\overset{|}{C}}HO)_{x'}-H \quad \text{(IX)}$$

where x and x' are each at least 6 and can range up to 120 or more and y is chosen so that the ethylene oxide block unit maintains the necessary balance of lipophilic and hydrophilic qualities necessary to retain surfactant activity. This balance is achieved when y is chosen so that the hydrophilic block unit constitutes from 4 to 96 percent by weight of the total block copolymer. Within the above ranges for x and x', y can range from 2 to 300 or more.

The preferred polyalkylene oxide block copolymer surfactants of formula II above are those satisfying the formula:

$$HO-(CH_2CH_2O)_y-(\overset{CH_3}{\overset{|}{C}}HCH_2O)_x-(CH_2CH_2O)_{y'}-H \quad \text{(X)}$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the hydrophilic block unit constitutes from 4 to 96 percent by weight of the total block copolymer; thus, within the above range for x, y and y' can range from 1 (preferably 2) to 320 or more.

The preferred polyalkylene oxide block copolymer moieties of formula IV above are those satisfying the formula:

$$H-(OCH_2CH_2)_y-(O\overset{CH_3}{\overset{|}{C}}HCH_2)_x- \quad \text{(XI)}$$

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from 4 to 96 percent (optimally 10 to 80 percent) by weight of the total block copolymer. In this instance the lipophilic alkylene oxide block linking unit, which includes the 1,2-propylene oxide repeating units and the linking moieties, consti-tutes from 4 to 96 percent (optimally 20 to 90 percent) of the total weight of the block copolymer. Within the above ranges, y can range from 1 (preferably 2) to 340 or more.

The preferred polyalkylene oxide block copolymer moieties of formula VI above are those satisfying the formula:

$$H-(O\overset{CH_3}{\overset{|}{C}}HCH_2)_x-(OCH_2CH_2)_y- \quad \text{(XII)}$$

where y is at least 1 (preferably at least 2) and can range up to 340 or more and x is chosen so that the 1,2-propylene oxide block unit maintains the necessary balance of lipophilic and hydrophilic qualities necessary to retain surfactant activity. This allows x to be chosen so that the hydrophilic block units together constitute from 4 to 96 percent (optimally 10 to 80 percent) by weight of the total block copolymer. In this instance the hydrophilic alkylene oxide block linking unit, which includes the ethylene oxide repeating units and the linking moieties, constitutes from 4 to 96 percent (optimally 20 to 90 percent) of the total weight of the block copolymer. Within the above ranges, x can range from 3 to 250 or more.

When the linking group L in formulae IV and VI is an amine group, z+z' equal three. The amine group can take any of the forms of the formula:

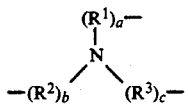

(XIII)

where $R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1.

When the linking group L in formulae IV and VI is a diamine group, z+z' equal four. The diamine group can take any of the forms of the formula:

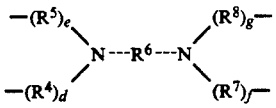

(XIV)

where $R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

When the polyalkylene oxide block copolymer surfactant is introduced into the dispersing medium prior to commencing the growth step, surfactant weight concentrations are contemplated as low as 0.1 percent, based on the interim weight of silver--that is, the weight of silver present in the emulsion at the time the surfactant is introduced. A preferred minimum surfactant concentration is 1 percent, based on the interim weight of silver. A broad range of surfactant concentrations have been observed to be effective. Lower concentrations of the surfactant are required to achieved maximum attainable reductions in dispersity when the percent of total silver introduced prior to introduction of the polyalkylene oxide is low. No further advantages has been realized for increasing surfactant weight concentrations above 7 times the interim weight of silver. However, surfactant concentrations of 10 the interim weight of silver or more are considered feasible.

In optimizing the process of this invention for minimum tabular grain dispersity levels (COV less than 10 percent) it has been observed that optimizations differ as a function of iodide incorporation in the grains as well as the choices of surfactants and/or peptizers.

While any conventional hydrophilic colloid peptizer can be employed in the practice of this invention, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.5 to achieve a minimum (less than 10 percent) COV. When a regular gelatino-peptizer is employed, the pH during twin plane formation is maintained at less than 3.0 to achieve a minimum COV.

Referring specifically to the surfactants of formulae I and IX, when regular gelatin is employed prior to the post-ripening grain growth, the surfactant is selected so that the hydrophilic block (i.e., —HAO—) accounts for 4 to 96 (preferably 5 to 85 and optimally 10 to 80) percent of the total surfactant molecular weight. It is preferred that x and x' be at least 6 and that the minimum molecular weight of the surfactant be at least 760 and optimally at least 1000. The concentration levels of surfactant are preferably restricted as iodide levels are increased. When oxidized gelatino-peptizer is employed prior to the post-ripening grain growth, no iodide is added during the post-ripening grain growth step and the hydrophilic block (e.g., HAO) accounts for 4 to 50 (optimally 10 to 40) percent of the total surfactant molecular weight. The minimum molecular weight of the surfactant continues to be determined by the minimum values of x and x' of 6. In optimized forms x and x' are at least 7, and the minimum molecular weight of the surfactant is 760 preferably 1000.

Referring specifically to the surfactants of formulae II and X, when regular gelatin is employed prior to post-ripening grain growth, the surfactants are selected so that the lipophilic block (i.e., —LAO—) accounts for 4 to 96 (preferably 15 to 95 and optimally 20 to 90) percent of the total surfactant molecular weight. It is preferred that x be at least 13 and that the minimum molecular weight of the surfactant be at least 800 and optimally at least 1000. The concentration levels of surfactant are preferably restricted as iodide levels are increased. When oxidized gelatino-peptizer is employed prior to post ripening grain growth, no iodide is added during post ripening grain growth step and the lipophilic block (i.e., —LAO—) accounts for 40 to 96 (optimally 50 to 90) percent of the total surfactant molecular weight. The minimum molecular weight of the surfactant continues to be determined by the minimum values of x—i.e., x=13. In optimized forms the minimum molecular weight of the surfactant is at least 800, preferably at least 1000.

Referring specifically to the surfactants of formulae III and XI, when regular gelatin is employed prior to post-ripening grain growth, the surfactant is selected so that the lipophilic alkylene oxide block linking unit (i.e., -LOL-) accounts for 4 to 96 (preferably 15 to 95 and optimally 20 to 90) percent of the total surfactant molecular weight. It is preferred that x be at least 3 and that the minimum molecular weight of the surfactant be at least 1100 and optimally at least 2000. The concentration levels of surfactant are preferably restricted as iodide levels are increased. When oxidized gelatino-peptizer is employed prior to post-ripening grain growth, no iodide is added during post-ripening grain growth and the lipophilic alkylene oxide block linking unit (e.g., LOL) accounts for 65 to 96 (optimally 70 to 90) percent of the total surfactant molecular weight. The minimum molecular weight of the surfactant continues to be determined by the minimum values of x—i.e., x=3. In optimized forms the minimum molecular weight of the surfactant is 1100, preferably 2000.

Referring specifically to the surfactants of formulae IV and XII, when regular gelatin is employed prior to post-ripening grain growth, the surfactant is selected so that the hydrophilic block linking unit (i.e., —HOL—) accounts for 4 to 96 (preferably 5 to 85 and optimally 10 to 80) percent of the total surfactant molecular weight. It is preferred that x be at least 3 and that the minimum molecular weight of the surfactant be at least 1100 and optimally at least 2000. The concentration levels of surfactant are preferably restricted as iodide levels are increased. When oxidized gelatino-peptizer is employed prior to post-ripening grain growth, no iodide is added during post-ripening grain growth and the hydrophilic block linking unit (i.e., —HOL—) accounts for 4 to 35 (optimally 10 to 30) percent of the total surfactant molecular weight. The minimum molecular weight of the surfactant continues to be determined by the minimum values of x—i.e., x=3. In optimized forms the minimum molecular weight of the surfactant is 1100, preferably 2000.

Ripening agents for use in the ripening step can be selected from among a broad range of conventional ripening agents. Thiocyanates and thioethers as well as their selenoether and telluroether analogues, each including both acyclic and cyclic ether forms, are specifically contemplated. Ammonia can be employed as a ripening agent during the ripening step. Specific examples of these ripening agents as well as other conventional ripening agents, such as those containing thiocarbonyl, selenocarbonyl or tellurocarbonyl groups (e.g., tetra-substituted middle chalcogen ureas), sulfites, specific mercapto compounds and compounds containing an imino group, are provided by McBride U.S. Pat. No. 3,271,157; Illingsworth U.S. Pat. No. 3,320,069; Jones U.S. Pat. No. 3,574,628; Rosecrants U.S. Pat. No. 3,737,313; Perignon U.S. Pat. No. 3,784,381; Sugimoto et al U.S. Pat. No. 4,551,421; Miyamoto et al U.S. Pat. No. 4,565,778; Bryan et al U.S. Pat. Nos. 4,695,534, 4,695,535 and 4,713,322; Friour et al U.S. Pat. No. 4,865,965; Kojima et al U.S. Pat. No. 5,028,522; Sasaki et al U.S. Pat. No. 4,923,794; Nakamura U.S. Pat. No. 4,956,260; Benard et al U.S. Pat. No. 4,752,560; and Mifune et al U.S. Pat. No. 5,004,679; the disclosures of which are here incorporated by reference. Saitou et al U.S. Pat. No. 4,797,354 is of particular interest in disclosing the use of a variety of ripening agents in the preparation of tabular grain emulsions of relatively low levels of dispersity. Preferred concentrations of ripening agents during the ripening step are in the range of from 0.01 to 0.1 N, with ammonia, thiocyanate, and thioether (along with seleno and telluroether analogues) being preferred.

Whereas Tsaur et al failed to achieve tabular grains when nucleation was undertaken in the presence of a ripening agent (note specifically Example 5, Tsaur et al U.S. Pat. No. 5,147,771) it has been observed that, when nucleation is conducted within the pAg boundary of Curve A, the presence of a ripening agent is not incompatible with obtaining tabular grains. Nucleation in the presence of a ripening agent and delayed addition of a polyalkylene oxide block copolymer surfactant according to the teachings of this disclosure produces low levels of grain dispersity while achieving higher grain ECDs than can be achieved when the surfactant is present during nucleation. It is generally preferred to employ lower ripening agent levels during nucleation than during the subsequent ripening step. Ripening agent concentrations during nucleation can range up to the polyalkylene oxide block copolymer surfactant levels present during nucleation taught by Tsaur et al.

Apart from the features that have been specifically discussed the tabular grain emulsion preparation procedures, the tabular grains that they produce, and their further use in photography can take any convenient conventional form. Such conventional features are illustrated by the following incorporated by reference disclosures:

ICBR-1 *Research Disclosure,* Vol. 308, December 1989, Item 308,119;

ICBR-2 *Research Disclosure,* Vol. 225. January 1983, Item 22,534;

ICBR-3 Wey et al U.S. Pat. No. 4,414,306, issued Nov. 8, 1983;

ICBR-4 Solberg et al U.S. Pat. No. 4,433,048, issued Feb. 21, 1984;

ICBR-5 Wilgus et al U.S. Pat. No. 4,434,226, issued Feb. 28, 1984;

ICBR-6 Maskasky U.S. Pat. No. 4,435,501, issued Mar. 6, 1984;

ICBR-7 Kofron et al U.S. Pat. No. 4,439,520, issued Mar. 27, 1987;

ICBR-8 Maskasky U.S. Pat. No. 4,643,966, issued Feb. 17, 1987;

ICBR-9 Daubendiek et al U.S. Pat. No. 4,672,027, issued Jan. 9, 1987;

ICBR-10 Daubendiek et al U.S. Pat. No. 4,693,964, issued Sept. 15, 1987;

ICBR-11 Maskasky U.S. Pat. No. 4,713,320, issued Dec. 15, 1987;

ICBR-12 Saitou et al U.S. Pat. No. 4,797,354, issued Jan. 10, 1989;

ICBR-13 Ikeda et al U.S. Pat. No. 4,806,461, issued Feb. 21, 1989;

ICBR-14 Makino et al U.S. Pat. No. 4,853,322, issued Aug. 1, 1989; and

ICBR-15 Daubendiek et al U.S. Pat. No. 4,914,014, issued Apr. 3, 1990.

EXAMPLES

The suffix E is employed to indicate Examples that demonstrate the process of the invention while the suffix C is employed to indicate Examples that provided for purposes of comparison. To facilitate comparison the preparation parameter of the comparative Example that fails to satisfy the requirements of the process of the invention as well as the inferior feature of the resulting emulsion are highlighted.

EXAMPLE 1E (AKT1018)

In a 4-liter reaction vessel was placed an aqueous gelatin solution (composed of 1 liter of water, 1.0 g of oxidized alkali-processed gelatin, 4.2 ml of 4 N nitric acid solution, and appropriate amount of sodium bromide to adjust the pAg of the vessel to 9.14), and while keeping the temperature thereof at 45 C., 8 ml of an aqueous solution of silver nitrate (containing 0.68 g of silver nitrate) and equal amount of an aqueous solution of sodium bromide (containing 0.43 g of sodium bromide) were simultaneously added thereto over a period of 1 minute at a constant rate. After 1 minute of mixing, pAg of the vessel was adjusted to 9.70 with a 1.0 M sodium bromide aqueous solution. Temperature of the mixture was subsequently raised to 60 C over a period of 9 minutes. At that time, 38.5 ml of an aqueous ammonia solution (containing 2.53 g of ammonia sulfate and 21.9 ml of 2.5 N sodium hydroxide solution) was added into the vessel and mixing was conducted for a period of 9 minutes. Then, 258 ml of an aqueous gelatin solution (containing 16.7 g of oxidized alkali-processed gelatin and 7.5 ml of 4 N nitric acid solution, and 78.7 wt %, based on total silver introduced in nucleation, of PLURONIC-31R1 TM, a surfactant satisfying formula IX, x=25, x'=25, y=7) was added to the mixture over a period of 2 minutes. After then, 25 ml of an aqueous silver nitrate solution (containing 2.12 g of silver nitrate) and 26.3 ml of an aqueous sodium bromide solution (containing 1.44 g of sodium bromide) were added at a constant rate for a period of 10 minutes. Then, 487.5 ml of an aqueous silver nitrate solution (containing 132.5 g of silver nitrate) and 485 ml of an aqueous sodium bromide solution (containing 83.8 g of sodium bromide) were simultaneously added to the aforesaid mixture at constant ramp starting from respective rate of 1.5 ml/min and 1.58 ml/min for the subsequent 75 minutes. Then, 232.7 ml of an aqueous silver nitrate solution (containing 63.2 g of silver nitrate) and 230.7 ml of an aqueous sodium bromide solution (containing 39.9 g of sodium bromide) were simultaneously added to the aforesaid mixture at constant rate over a period of 20.2 minutes. The silver halide emulsion thus obtained was washed. The properties of grains of this emulsion are as follows:

Average Grain Size: 2.10 μm
Average Grain Thickness: 0.148 μm
Aspect Ratio of the Grains: 14.2
Average Tabularity of Grains: 95.8
Coefficient of Variation of Total Grains: 7.4%

EXAMPLE 2C (AKT1016)

Example 1 was repeated except that PLURONIC-31R1 was not added at all in the precipitation. The emulsion thus made is characterized as follows:

Average Grain Size: 2.70 μm
Average Grain Thickness: 0.085 μm
Aspect Ratio of the Grains: 31.8
Average Tabularity of Grains: 374
Coefficient of Variation of Total Grains: 33.6%

EXAMPLE 3E (AKT1021)

Example 1 was repeated except that the same amount of PLURONIC-31R1 was not added until 1.4% of silver halide was precipitated. The emulsion thus made is characterized as follows:

Average Grain Size: 1.96 μm
Average Grain Thickness: 0.142 μm
Aspect Ratio of the Grains: 13.8
Average Tabularity of Grains: 97.2
Coefficient of Variation of Total Grains: 11.1%

EXAMPLE 4E (AKT1031)

Example 1 was repeated except that the same amount of PLURONIC-31R1 was not added until 4.4% of silver halide was precipitated. The emulsion thus made is characterized as follows:

Average Grain Size: 2.10 μm
Average Grain Thickness: 0.140 μm
Aspect Ratio of the Grains: 14.8
Average Tabularity of Grains: 105.6
Coefficient of Variation of Total Grains: 10.1%

EXAMPLE 5E (AKT1032)

Example 1 was repeated except that the same amount of PLURONIC-31R1 was not added until 9.2% of silver halide was precipitated. The emulsion thus made is characterized as follows:

Average Grain Size: 2.30 μm
Average Grain Thickness: 0.131 μm
Aspect Ratio of the Grains: 17.6
Average Tabularity of Grains: 134
Coefficient of Variation of Total Grains: 13.1%

EXAMPLE 6E (AKT1038)

Example 1 was repeated except that the same amount of PLURONIC-31R1 was not added until 15.8% of silver halide was precipitated. The emulsion thus made is characterized as follows:

Average Grain Size: 2.40 μm
Average Grain Thickness: 0.115 μm
Aspect Ratio of the Grains: 20.9
Average Tabularity of Grains: 181.5
Coefficient of Variation of Total Grains: 16.8%

EXAMPLE 7E (AKT1039)

Example 1 was repeated except that the same amount of PLURONIC-31R1 was not added until 24.2% of silver halide was precipitated. The emulsion thus made is characterized as follows:

Average Grain Size: 2.70 μm
Average Grain Thickness: 0.112 μm
Aspect Ratio of the Grains: 24.1
Average Tabularity of Grains: 215.2
Coefficient of Variation of Total Grains: 23.0%

As indicated in Examples 1E and 3E to 7E inclusive, adding PLURONIC-31R1 after twinning leads to a tabular grain emulsion with reduced COV as compared with Example 2C. This is only true, however, under certain nucleation conditions as illustrated below.

EXAMPLE 8C (AKT1048)

Example 1E was repeated except that the pAg of the vessel was adjusted to a pAg of 7.92. The emulsion thus made is characterized as follows:

Average Grain Size: 3.10 μm
Average Grain Thickness: 0.210 μm
Aspect Ratio of the Grains: 14.8
Average Tabularity of Grains: 70.3
Coefficient of Variation of Total Grains: 63.0%

EXAMPLE 9C (AKT1056)

Example 8C was repeated except that the same amount of PLURONIC-31R1 was placed in the reaction vessel prior to the precipitation. The emulsion thus made is characterized as follows:

Average Grain Size: 1 77 μm
Average Grain Thickness: 0.142 μm
Aspect Ratio of the Grains: 12.5
Average Tabularity of Grains: 87.8
Coefficient of Variation of Total Grains: 7.7%

EXAMPLE 10E (AKT1050)

Example 1 was repeated except that the pAg of the vessel was adjusted to a pAg of 8.71. The emulsion thus made is characterized as follows:

Average Grain Size: 2.90 μm
Average Grain Thickness: 0.194 μm
Aspect Ratio of the Grains: 14.9
Average Tabularity of Grains: 77
Coefficient of Variation of Total Grains: 10.1%

EXAMPLE 11C (AKT1058)

Example 10E was repeated except that the same amount of PLURONIC-31R1 was placed in the reaction vessel prior to the precipitation. The emulsion thus made is characterized as follows:

Average Grain Size: 1.80 μm
Average Grain Thickness: 0.149 μm
Aspect Ratio of the Grains: 12.1
Average Tabularity of Grains: 81.1
Coefficient of Variation of Total Grains: 7.0%

EXAMPLE 12E (AKT1051)

Example 1 was repeated except that the pAg of the vessel was adjusted to a pAg of 8.90. The emulsion thus made is characterized as follows:

Average Grain Size: 2.30 μm
Average Grain Thickness: 0.159 μm
Aspect Ratio of the Grains: 14.5
Average Tabularity of Grains: 91
Coefficient of Variation of Total Grains: 8.8%

EXAMPLE 13C (AKT1059)

Example 12E was repeated except that the same amount of PLURONIC-31R1 was placed in the reaction vessel prior to the precipitation. The emulsion thus made is characterized as follows:

Average Grain Size: 1.76 μm

Average Grain Thickness: 0.148 μm
Aspect Ratio of the Grains: 11.9
Average Tabularity of Grains: 80.4
Coefficient of Variation of Total Grains: 8.8%

EXAMPLE 14C (AKT1029)

Example 1 was repeated except that the same amount of PLURONIC-31R1 was placed in the reaction vessel prior to the precipitation. The emulsion thus made is characterized as follows:

Average Grain Size: 1.65 μm
Average Grain Thickness: 0.130 μm
Aspect Ratio of the Grains: 12.7
Average Tabularity of Grains: 97.6
Coefficient of Variation of Total Grains: 7.7%

EXAMPLE 15E (AKT1052)

Example 1 was repeated except that the pAg of the vessel was adjusted to a pAg of 9.70. The emulsion thus made is characterized as follows:

Average Grain Size: 2.30 μm
Average Grain Thickness: 0.154 μm
Aspect Ratio of the Grains: 14.9
Average Tabularity of Grains: 97
Coefficient of Variation of Total Grains: 11.1%

EXAMPLE 16C (AKT1060)

Example 17 was repeated except that the same amount of PLURONIC-31R1 was placed in the reaction vessel prior to the precipitation. The emulsion thus made is characterized as follows:

Average Grain Size: 1.47 μm
Average Grain Thickness: 0.135 μm
Aspect Ratio of the Grains: 10.9
Average Tabularity of Grains: 80.7
Coefficient of Variation of Total Grains: 10.1%

From the comparisons provided above it is apparent that introducing the polyalkylene oxide block copolymer surfactant into the dispersing medium prior to twin plane formation results in reducing the ECD of the tabular grains as compared to the ECD that can be realized by delaying addition of the surfactant until after a population of grain nuclei containing twin planes has been formed. The comparisons further demonstrate that forming the twin planes at a pAg outside the boundary of Curve A in FIG. 1 (i.e., less than 8.0 at 45° C.) results in elevated levels of tabular grain dispersity.

EXAMPLES 17–23

These Examples demonstrate the feasibility of having a ripening agent in the dispersing medium at nucleation when the precipitation process of the invention is employed.

EXAMPLE 17C (SHK570)

A 2.7%I bromoiodide tabular emulsion was precipitated by a double jet procedure. No Pluronic-31R1 was employed during the precipitation. The following procedure produced 1 mole of total silver precipitation: 0.0083 mole of silver was introduced for 1 min by 2N AgN03 while maintaining pAg 9.7 by adding salt solution A (1.97N NaBr and 0.02N KI) to a vessel filled with 833cc aqueous solution containing 1.87g/1 bone gel and 2.5g/1 NaBr at pH 1.85 and 45C. After adjusting pAg to 9.8 by NaBr, temperature was raised to 60C. and 13.85 cc of 0.766 mole/1 ammonium sulfate was added. pH of the vessel was brought to 9.5 by 2.5 N NaOH followed by 9 min hold. Then, the pAg was adjusted to 9.2 by addition of aqueous gelatin solution("growth gel") containing 100 g/1 bone gel and the pH was adjusted to 5.8. The emulsion was then grown at pAg 9.2 for 55.83 min by accelerated flows of 1.6 N AgN03 and salt solution B(1.66N NaBr and 0.0168N KI). At this point which completed 70.5% of total silver precipitation, a preformed AgI emulsion (0.05 μm) was added to make total 2.7%I. After 3 min, the remaining 29.5% of total silver was precipitated with 1.6N AgN03 and 1.68 N NaBr at pAg 8.7 for 13.3 min. The resultant emulsion was washed by a ultrafiltration technique and pH and pAg were adjusted to 5.5 and 8.2, respectively.

Average Grain Size: 1.58 μm
Average Grain Thickness: 0.084 μm
Aspect Ratio of the Grains: 18.8
Average Tabularity of Grains: 223.9
Coefficient of Variation of Total Grains: 25%

EXAMPLE 18C (SHK591)

Example 17C was repeated, except that PLURONIC-31R1 surfactant was introduced into the dispersing medium prior to precipitation. Although the coefficient of variation of the emulsion was reduced, the average grain size was also reduced.

Average Grain Size: 1.39 μm
Average Grain Thickness: 0.128 μm
Aspect Ratio of the Grains: 10.9
Average Tabularity of Grains: 84.8
Coefficient of Variation of Total Grains: 12.0%

EXAMPLE 19C (SHK589)

Example 17C was repeated, except 0.058 g of the ripening agent 1,8-dihydroxy-3,6-dithiaoctane (RA-1) was introduced into the dispersing medium prior to precipitation. Although the ripening agent increased the average grain size, it did not lower the total grain coefficient of variation.

Average Grain Size: 1.69 μm
Average Grain Thickness: 0.132 μm
Aspect Ratio of the Grains: 12.8
Average Tabularity of Grains: 97.0
Coefficient of Variation of Total Grains: 25%

EXAMPLE 20C (SHK590)

Example 17C was repeated, except that 0.024 g PLURONIC-31R1 surfactant and 0.058 g RA-1 ripening agent were introduced into the dispersing medium before precipitation. The total grain coefficient of variation was reduced, but the average grain size was smaller than in Examples 17C and 19C.

Average Grain Size: 1.35 μm
Average Grain Thickness: 0.169 μm
Aspect Ratio of the Grains: 8.0
Average Tabularity of Grains: 47.3
Coefficient of Variation of Total Grains: 13%

EXAMPLE 21E (SHK592)

Example 20C was repeated, except that the PLURONIC-31R1 was not introduced into the dispersing medium until after 0.0083 mole of silver was introduced. By delaying the introduction of the surfactant it was possible to achieve the average grain size of Example 17C while also realizing a lower total grain coefficient of variation.

Average Grain Size: 1.60 μm
Average Grain Thickness: 0.144 μm
Aspect Ratio of the Grains: 11.1
Average Tabularity of Grains: 77.2

Coefficient of Variation of Total Grains: 15%

EXAMPLE 22C (SHK1650)

Example 19C was repeated, except 0.0091 g of the ripening agent 1,10-dithia-4,7,12,16-tetraoxacyclooctadecane (RA-2) was substituted for RA-1.

Average Grain Size: 1.71 μm
Average Grain Thickness: 0.131 μm
Aspect Ratio of the Grains: 13.0
Average Tabularity of Grains: 99.6
Coefficient of Variation of Total Grains: 38.4%

EXAMPLE 23E (SHK1653)

Example 22C was repeated, except that 0.048 g PLURONIC-31R1 surfactant was introduced into the dispersing medium after 0.0083 mole of silver was introduced.

Average Grain Size: 1.52 μm
Average Grain Thickness: 0.159 μm
Aspect Ratio of the Grains: 9.6
Average Tabularity of Grains: 60.1
Coefficient of Variation of Total Grains: 15.6%

The invention has been described in detail with particular reference to preferred embodiments thereof, but it will be understood that variations and modifications can be effected within the spirit and scope of the invention.

What is claimed is:

1. A process of accelerating the preparation of a photographic emulsion containing tabular silver halide grains exhibiting a reduced degree of total grain dispersity comprising providing a dispersing medium containing halide ions consisting essentially of bromide ions, forming in the dispersing medium a population of silver halide grain nuclei containing parallel twin planes, ripening out a portion of the grain nuclei, and growing the remaining silver halide grain nuclei containing parallel twin planes to form tabular silver halide grains,

WHEREIN the twin planes are formed in the silver halide grain nuclei within the pAg and temperature boundaries of Curve A in FIG. 1 and a polyalkylene oxide block copolymer surfactant is introduced into the emulsion, introduction being delayed until after the silver halide nuclei containing twin planes have been formed, but introduction occurring before 25 percent of the total silver used to form the emulsion has been introduced, the surfactant being chosen from the class consisting of (a) polyalkylene oxide block copolymer surfactants comprised of at least two terminal lipophilic alkylene oxide block units linked by a hydrophilic alkylene oxide block unit accounting for from 4 to 96 percent of the molecular weight of the copolymer and (b) polyalkylene oxide block copolymer surfactants comprised of at least two terminal hydrophilic alkylene oxide block units linked by a lipophilic alkylene oxide block unit accounting for from 4 to 96 percent of the molecular weight of the copolymer.

2. A process of accelerating the preparation of an emulsion according to claim 1 wherein twin plane formation is undertaken at a pH of less than 6.

3. A process of accelerating the preparation of an emulsion according to claim 1 wherein twin plane formation prior to ripening out a portion of the grains utilizes from 0.05 to 2.0 percent of the total silver used to form the emulsion.

4. A process of accelerating the preparation of an emulsion according to claim 1 wherein a silver halide solvent is used to ripen out a portion of the silver halide grains.

5. A process of accelerating the preparation of an emulsion according to claim 1 wherein at least a portion of the polyalkylene oxide block copolymer is introduced into the dispersing medium before more than 10 percent of the total silver halide been introduced.

6. A process of accelerating the preparation of an emulsion according to claim 5 wherein at least a portion of the polyalkylene oxide block copolymer is introduced into the dispersing medium before more than 5 percent of the total silver halide been introduced.

7. A process of accelerating the preparation of an emulsion according to claim 1 wherein the concentration of the polyalkylene oxide block copolymer introduced into the dispersing medium is in the range of from 1 percent to 7 times the weight of silver present.

8. A process of accelerating the preparation of an emulsion according to claim 1 wherein the silver halide grain nuclei are formed within the pAg and temperature boundaries of Curve B in FIG. 1.

9. A process of accelerating the preparation of an emulsion according to claim 1 wherein the polyalkylene oxide block copolymer satisfies the formula:

LAO—HAO—LAO where

LAO— represents a terminal lipophilic alkylene oxide block unit,

—HAO— represents a linking hydrophilic alkylene oxide block unit and the molecular weight of the polyalkylene oxide block copolymer is in the range of from 760 to 16,000.

10. A process of accelerating the preparation of an emulsion according to claim 1 wherein the polyalkylene oxide block copolymer satisfies the formula:

HAO—LAO—HAO where

HAO— represents a terminal hydrophilic alkylene oxide block unit,

—LAO— represents a linking lipophilic alkylene oxide block unit, and the molecular weight of the polyalkylene oxide block copolymer is in the range of from 800 to 30,000.

11. A process of accelerating the preparation of an emulsion according to claim 1 wherein the polyalkylene oxide block copolymer satisfies the formula:

$(HAO)_z$—LOL—$(HAO)_z$ where

HAO represents a terminal hydrophilic alkylene oxide block unit,

—LOL— represents a lipophilic alkylene oxide block linking unit, z is 2, z' is 1 or 2, and the molecular weight of the polyalkylene oxide block copolymer is in the range of from 1,100 to 60,000.

12. A process of accelerating the preparation of an emulsion according to claim 11 wherein the polyalkylene oxide block copolymer satisfies the formula:

$$(HAO—LAO)_z—L—(LAO—HAO)_{z'}$$

where

HAO— represents a terminal hydrophilic alkylene oxide block unit,

—LAO— represents a lipophilic alkylene oxide block unit, and

—L— represents an amine or diamine linking group.

13. A process of accelerating the preparation of an emulsion according to claim 1 wherein the polyalkylene oxide block copolymer satisfies the formula:

$$(LAO)_z—HOL—(LAO)_{z'}$$

where

LAO— represents a terminal lipophilic alkylene oxide block unit,

—HOL— represents a hydrophilic alkylene oxide block linking unit, z is 2, z' is 1 or 2, and the molecular weight of the polyalkylene oxide block copolymer is in the range of from 1,100 to 50,000.

14. A process of accelerating the preparation of an emulsion according to claim 13 wherein the polyalkylene oxide block copolymer satisfies the formula:

$$(LAO—HAO)_z—L—(HAO—LAO)_{z'}$$

where

LAO— represents a terminal lipophilic alkylene oxide block unit, —HAO— represents a hydrophilic alkylene oxide block unit, and —L— represents an amine or diamine linking group.

15. A process of accelerating the preparation of an emulsion according to claim 1 wherein (i) the lipophilic alkylene oxide block units contain repeating units satisfying the formula:

$$-(\overset{\overset{R}{|}}{C}HCH_2O)-$$

where

R is a hydrocarbon of from 1 to 10 carbon atoms, and (ii) the hydrophilic alkylene oxide block unit is comprised of repeating units satisfying the formula:

$$-(\overset{\overset{R^1}{|}}{C}HCH_2O)-$$

where $R^1$ is hydrogen or a hydrocarbon of from 1 to 10 carbon atoms substituted with at least one polar group.

16. A process of accelerating the preparation of an emulsion according to claim 15 wherein (i) the lipophilic alkylene oxide block units contain repeating units satisfying the formula:

$$-(\overset{\overset{CH_3}{|}}{C}HCH_2O)-$$

and (ii) the hydrophilic alkylene oxide block unit is comprised of repeating units satisfying the formula:

$$-(CH_2CH_2O)- .$$

17. A process according to claim 1 wherein grain nucleation is undertaken in the presence of a gelatino-peptizer containing at least 30 micromoles of methionine per gram and twin plane formation is undertaken at a pH of less than 3.0.

18. A process according to claim 17 wherein the gelatino-peptizer contains less than 12 micromoles of methionine per gram.

* * * * *